US005973298A

United States Patent [19]

Källgren

[11] Patent Number: 5,973,298

[45] Date of Patent: Oct. 26, 1999

[54] CIRCULAR FILM HEATER AND PORCELAIN ENAMEL COOKTOP

[75] Inventor: Johan Källgren, Bromma, Sweden

[73] Assignee: White Consolidated Industries, Inc., Cleveland, Ohio

[21] Appl. No.: 09/067,135

[22] Filed: Apr. 27, 1998

[51] Int. Cl.[6] ..... H05B 3/68; H05B 3/16

[52] U.S. Cl. ..... 219/465.1; 219/543

[58] Field of Search ..... 219/465.1, 466.1, 219/468.2, 542, 543, 544; 338/284, 285, 307, 308, 309, 311

[56] References Cited

U.S. PATENT DOCUMENTS

| | | | |
|---|---|---|---|
| 851,440 | 4/1907 | Rivers | 338/285 |
| 1,352,934 | 9/1920 | Arntzen et al. | 338/285 |
| 2,026,797 | 1/1936 | Pierson . | |
| 3,167,638 | 1/1965 | Hornaday, Jr. et al. . | |
| 3,694,627 | 9/1972 | Blatchford et al. | 219/466.1 |
| 3,895,216 | 7/1975 | Hurko . | |
| 4,002,883 | 1/1977 | Hurko | 219/466.1 |
| 4,233,497 | 11/1980 | Lowell . | |
| 4,384,192 | 5/1983 | Lowell . | |
| 4,508,961 | 4/1985 | McWilliams . | |
| 4,538,051 | 8/1985 | Schreder et al. . | |
| 4,843,218 | 6/1989 | Husslein et al. . | |
| 4,860,434 | 8/1989 | Louison et al. . | |
| 4,970,375 | 11/1990 | Schittenhelm et al. . | |
| 4,973,826 | 11/1990 | Baudry et al. . | |
| 5,019,691 | 5/1991 | Lai . | |
| 5,043,559 | 8/1991 | Scott . | |
| 5,160,830 | 11/1992 | Kicherer et al. . | |
| 5,270,519 | 12/1993 | Higgins . | |
| 5,331,134 | 7/1994 | Kimura . | |
| 5,352,864 | 10/1994 | Schultheis et al. . | |
| 5,471,737 | 12/1995 | McWilliams . | |
| 5,512,731 | 4/1996 | McWilliams . | |
| 5,616,266 | 4/1997 | Cooper . | |

*Primary Examiner*—Teresa Walberg
*Assistant Examiner*—Sam Paik
*Attorney, Agent, or Firm*—Pearne, Gordon, McCoy & Granger LLP

[57] ABSTRACT

A range cook top is provided with circular heating zones having a layer of resistive thin film thereon. Slots in the cook top separate the heating zones from the surrounding areas of the cook top. Tongues of cook top material interrupt the slots and support the heating zones. The slots have beveled or stepped edges and beveled or stepped plastic inserts fill the slots to provide a smooth cook top. Sealer also fills the slots. The resistive layer in the heating zone is divided into arcuate segments by insulating partitions. Power supply bus bars are disposed around the outside edge of the resistive layer. A common bus bar interconnects the segments at the inner edges. A dual heater has separately controlled inner and outer resistive layers.

14 Claims, 5 Drawing Sheets

CIRCULAR FILM HEATER AND PORCELAIN ENAMEL COOKTOP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates generally to the field of heating and cooking and specifically to a resistance heater.

Electrical resistance heating films are used in various applications. Typically, the resistive film is applied on a substrate, which may provide a heating surface or may be the surface to be heated. A controlled voltage or current is applied to the film to effect the creation of heat energy. Examples of film heaters and controllers therefor are described in U.S. Pat. No. 4,233,497 to Lowell, U.S. Pat. No. 4,384,192 to Lowell, U.S. Pat. No. 4,973,826 to Baudry, U.S. Pat. No. 5,160,830 to Kicherer and U.S. Pat. No. 5,616,266 to Cooper.

Range cook tops for cooking food use electric heaters. It is desirable to provide a durable surface for supporting objects so that the objects can be heated efficiently and reliably. Heating of the surface should be limited to a desired area.

BRIEF SUMMARY OF THE INVENTION

The present invention provides a heater including a substrate and a slot in the substrate to define a heating zone. A resistive layer is applied to the substrate over at least part of the heating zone. Bus bars are connected to provide a voltage across the resistive layer.

The slot is through the substrate. Tongues interrupt the slot and support the heating zone. The tongues are formed by substrate material remaining when the slot is formed. A thermally insulating insert is disposed in the slot. A sealant is disposed between the insert and the substrate. The slot has beveled or stepped edges and the insert is dovetailed or stepped to complement the slot. A dielectric layer is disposed between the substrate and the resistive film. A sealing layer is disposed over the resistive film.

According to another aspect, the invention is a heater including a substrate having a heating zone and a resistive layer disposed on at least part of the heating zone and divided into segments. An insulating partition separates the segments of the resistive layer. A common bus bar connects the segments of the resistive layer. Supply bus bars are connected to respective segments of the resistive layer and connected to respective power leads. The segments are semicircular and the supply bus bars are disposed circumferentially along outer edges of the respective segments. The common bus bar is disposed circumferentially along inner edges of the respective segments. The partition has three parts dividing the resistive layer into three substantially identical, arcuate segments and the supply bus bars are connected to respective leads of a three-phase power supply. An annular second resistive layer substantially surrounds the first resistive layer. An insulating ring separates the first resistive layer from the second resistive layer. Insulating partitions divide the second resistive layer into four arcuate segments. A first inner bus bar connects two of the segments of the second resistive layer and a second inner bus bar connects the other two segments of the second resistive layer. A connecting outer bus bar connects two of the segments of the second resistive layer that are not connected together by the inner bus bars. Two outer supply bus bars are respectively connected to the two segments of the second resistive layer that are not connected together by the connecting outer bus bar. The outer supply bus bars are connected to respective power leads.

DESCRIPTION OF THE INVENTION

Figure 1:
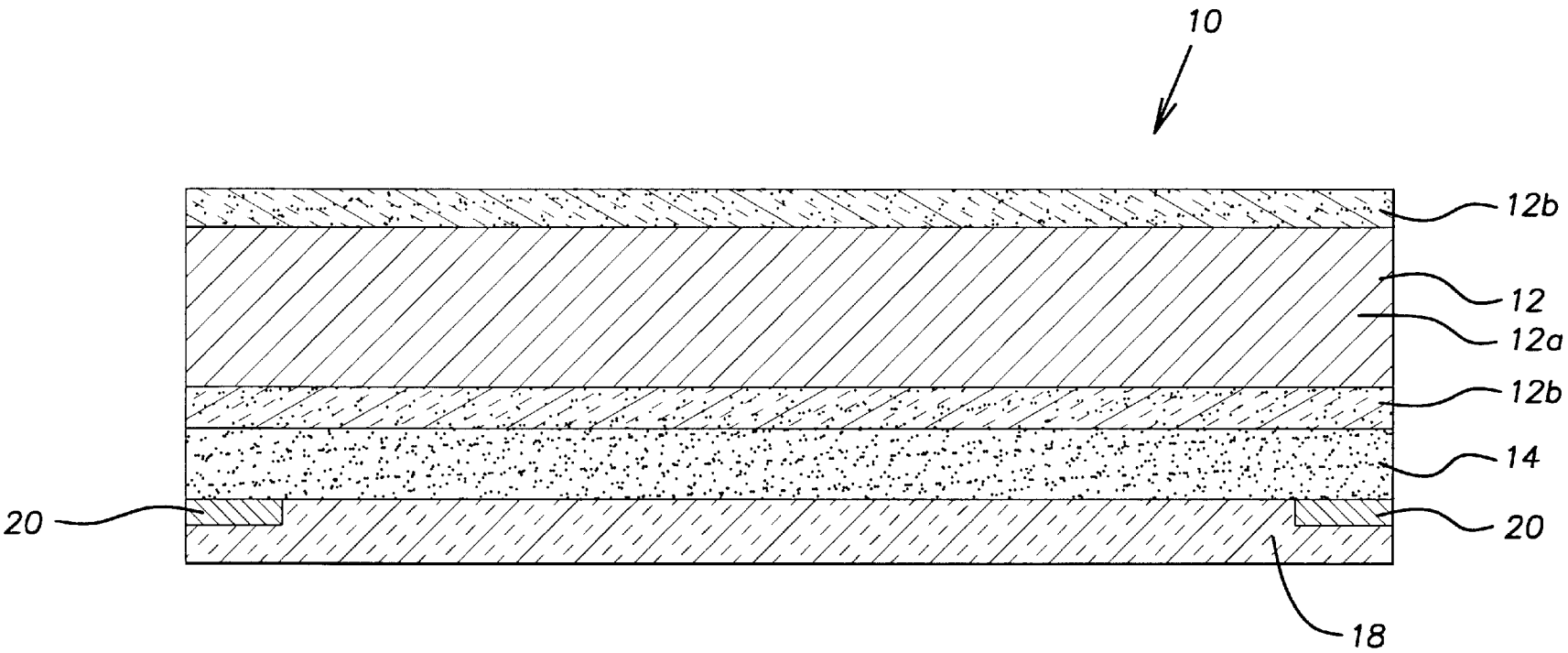
FIG. 1 shows a schematic elevational view of a heating element according to the invention.

Referring to FIG. 1, a heating apparatus, such a range cook top 10, includes a generally horizontal planar surface forming a substrate 12. A heating zone is formed on the substrate 12 and includes a resistive film layer 14 deposited on the substrate. A dielectric layer (not shown) can be disposed between the resistive film layer 14 and the substrate 12. A sealing layer 18 can be disposed over the resistive film 14. FIG. 1 is schematic and the relative thicknesses of the layers do not represent actual thicknesses.

The substrate 12 is preferably a thermal shock resistant, rigid, and planar structure having a low electrical conductivity and suitable for supporting objects to be heated. Preferably, the substrate 12 is porcelain enameled (P-E) steel about 2.5 mm thick, that is, 2.0 mm of steel 12*a* with about 0.25 mm of porcelain enamel 12*b* on each side. Other materials having the desired properties may also be suitable. For example, LAS glass ceramic or $Si_3N_4$ ceramic about 4.0 mm thick can be used in some cases. In a domestic range cook top application, for example, the substrate 12 is supported by a frame of the range and forms the base of the cook top.

The resistive film 14 is preferably a thin film of atmospheric chemical vapor deposition (ACVD) applied F-doped or Sb-doped $SnO_2$ able to withstand a power density of 1.5 to 13 W/cm$^2$ and a current density between 11,000 and 90,000 A/cm$^2$. A voltage applied across the film causes a current to flow through the film thereby heating the film. Preferably, the thin film has a positive temperature coefficient (PTC) to prevent thermal run away. A PTC film also provides even heating because cold spots draw more current and hot spots draw less current. Other materials having the desired properties may also be suitable. Because its resistance varies as a function of temperature, the resistive film can also be used as a temperature sensor. Alternatively, a separate temperature sensor can be located at the heating zone for closed loop temperature control.

One layer of the porcelain enamel 12*b* acts as the dielectric layer. When the substrate is glass ceramic, the dielectric layer is preferably a sol gel applied $SiO_2$/AlN or a screen printed and fired glass layer. The dielectric layer preferably insulates the substrate from currents flowing in the resistive film 14 and has a dielectric constant of about 5 to 8 (at room temperature and 50–60 Hz). The dielectric constant should be as low and as stable as possible over the operating temperature range of the heater, which is about 20° C. to 500° C. The dielectric layer should not substantially limit heat conduction from the resistive film to the substrate. Other materials having the desired properties may also be suitable.

The sealing layer 18 is a heat resistant, rigid material having high electrical insulating properties and high heat conductivity. Preferably, glass or a sol gel applied ceramic, such as $SiO_2$/AlN is used.

Electrically conductive bus bars 20, such as cermet based silver thick film, are disposed on the resistive film layer 14 and preferably covered by the sealing layer 18. The bus bars 20 are connected to a power supply for providing a controlled current or voltage to the resistive film 14. The bus bar configurations and connections are discussed below.

Figure 2:
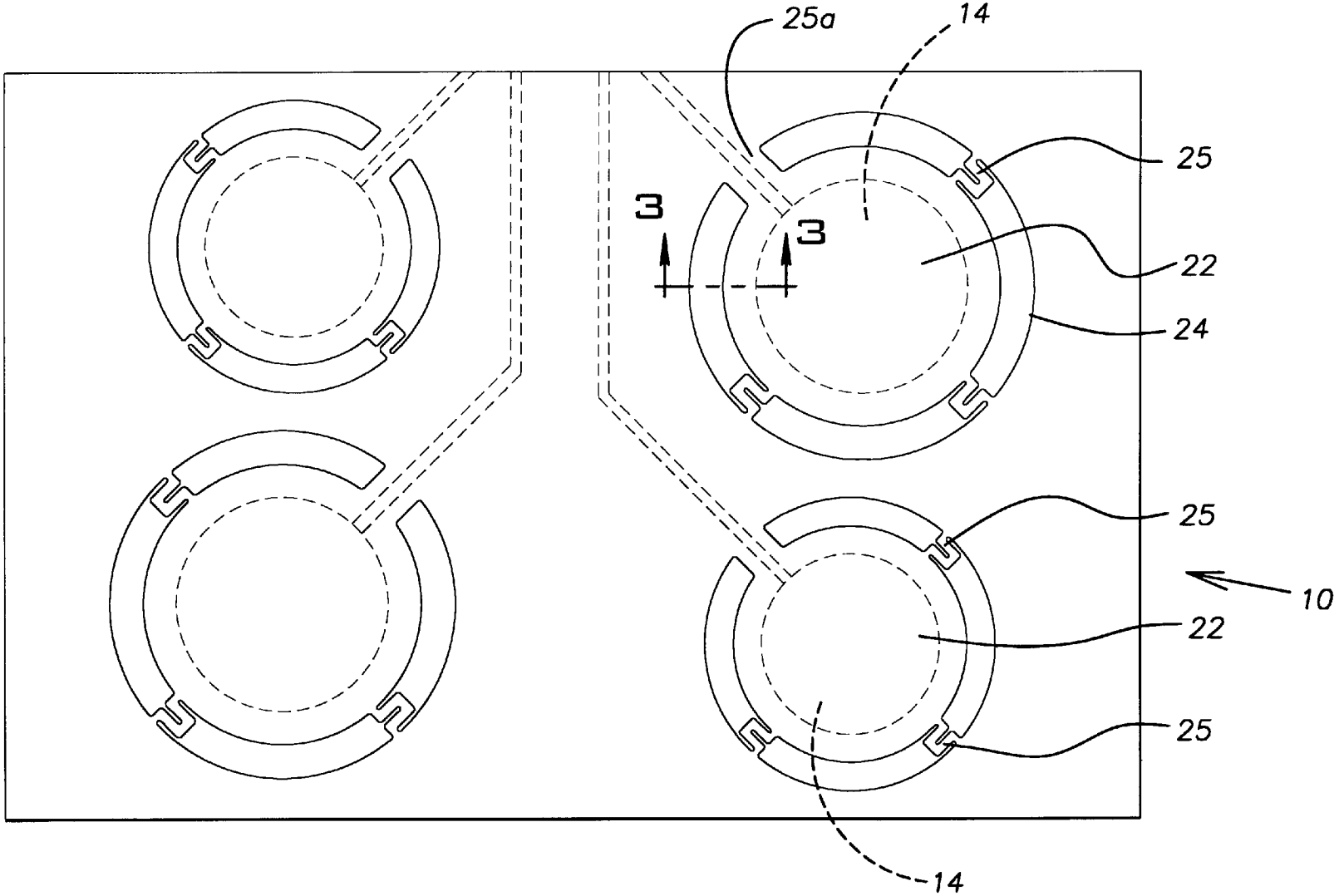
FIG. 2 shows a top view of a range cook top according to the invention.

Referring to FIG. 2, the cook top 10 includes several heating zones 22. Each heating zone 22 includes resistive film disposed on the substrate as discussed above. Preferably, the heating zones 22 are circular and correspond in size with conventional large and small cook top element sizes, for example, about 235 mm and 160 mm in diameter. The heating zone 22 is separated from the remaining area of the cook top 10 by a circumferential slot 24. The slot 24 thermally insulates the cook top 10 from the heating zone 22. The resistive film does not extend past the slot. The slot 24 is discontinuous, interrupted by circumferentially spaced tongues 25. The tongues provide mechanical support for the heating zone and can provide a path for running electrical connections, such as conductive bus bar layers. Preferably, the tongues 25 are formed by leaving substrate material when the slot 24 is formed. Thus, the tongues have the same thickness as the substrate, but do not have porcelain enamel applied thereto expect where a path is provided for electrical conductors, wherein the enamel provides electrical insulation between the substrate and electrical conductors. One of the tongues 25*a* extends directly across the slot to serve as a bridge for simple routing of the bus bars. The other tongues 25 follow a serpentine path across the slot. The serpentine tongues allow for thermal expansion of the cook top elements. The width and number of tongues are selected to provide support for the physical loads placed on the heating zone. For example, four evenly spaced tongues 25, three having a width of about 4.0 to 4.5 mm, an offset of 12 mm, and thickness of 2.0 mm, and the bridge tongue 25*a* having a width of about 20 mm for a 2.5 mm substrate thickness, are adequate. Alternatively, the tongues 25 can be separate parts, such as insulating fasteners, added to secure the heating zone to the cook top.

Figure 3A:
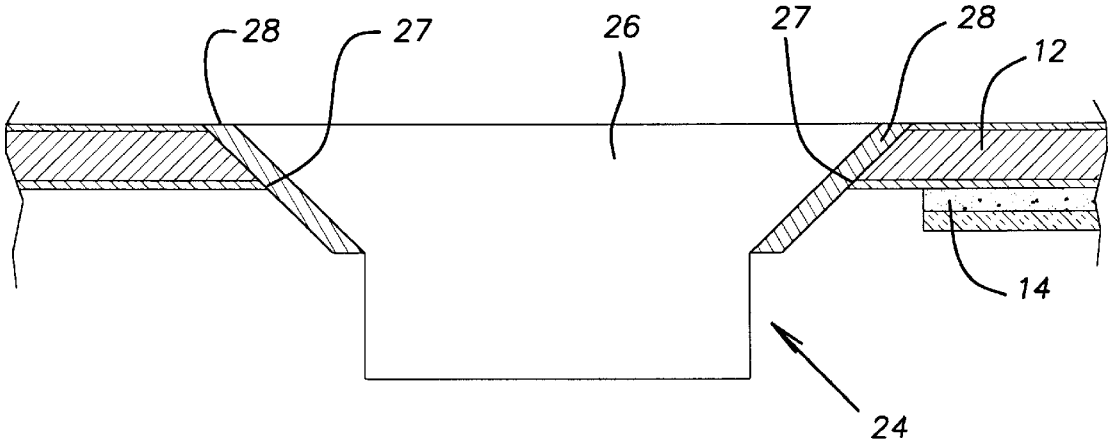
FIGS. 3A and 3B show section views of the cook top at an edge of a heating zone taken from line 3—3 of FIG. 2 according to different aspects of the invention.

Referring to FIGS. 2 and 3A, an insert 26 is provided in the slot. Preferably, the insert 26 is made from a heat resistant and thermally insulating material, such as a molded ceramic or heat resistant plastic. A heat resistant sealer 28, such as silicone, seals the slot and retains the insert 26 in place. The sealer 28 prevents passage of liquid through the slot and allows for expansion and contraction of components. The insert 26 is dovetailed and the slot is provided with beveled edges 27 to support the insert.

Figure 3B:
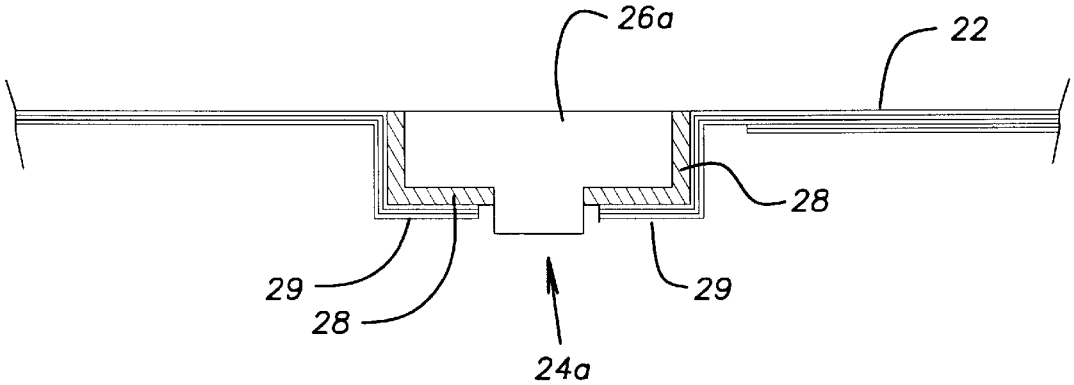

Referring to FIGS. 2 and 3B, a different insert 26*a* can be provided in the slot 24*a*. Edges of the substrate defining the slot 24*a* are bent to form steps 29 defined by two right angle bends in each edge. Preferably, the steps 29 are formed by stamping when the slot is formed. The insert 26*a* has a T-shaped cross-section having a stepped bottom complementing the steps of the slot.

The insert 26 or 26*a* has a top surface substantially coplanar with the top surface of the substrate so that the cook top is smooth. A heat resistant sealant can be applied over the entire cook top to provide a uniform surface.

Preferably, the slot 24 is spaced from the heating zone 22 to provide a circumferential ring of substrate that does not have a resistive heating layer applied thereon. Alternatively, the slot can be located at the edge of heating zone to define the boundary of the heating zone.

Different arrangements of the bus bars and heating layers are possible, depending on the power supply, cost limitations, heating effect desired, and other factors. Several examples are described below with reference to the figures.

Figure 4:
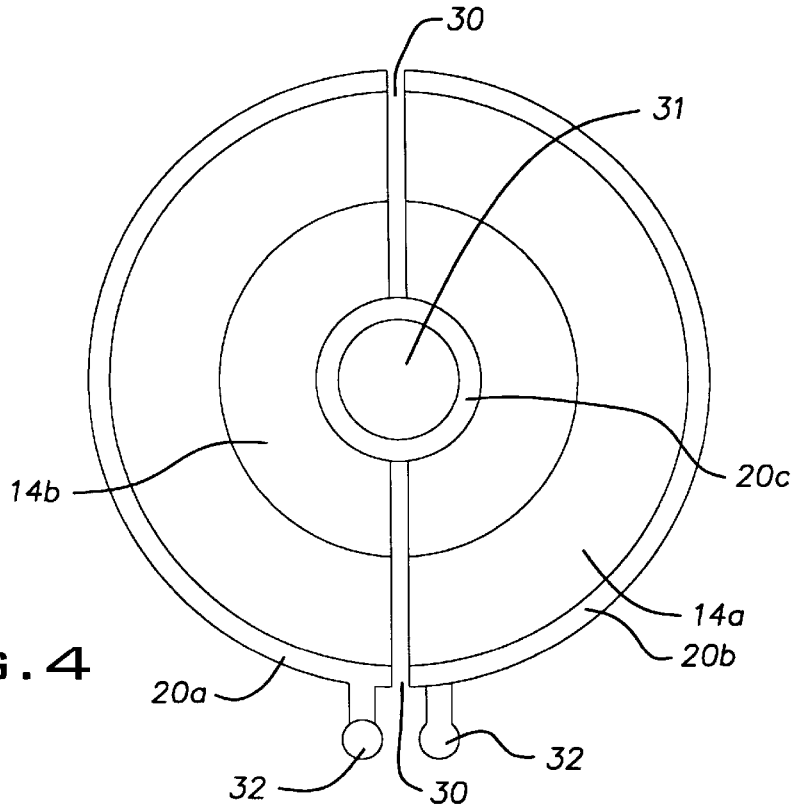
FIG. 4 shows a schematic diagram of a two-phase heater according to one aspect of the invention.

Referring to FIG. 4, the bus bars 20 are connected to respective legs of a two-phase power system providing a nominal 240 volts AC. A hot supply bus bar 20*a* is disposed along half of the outer edge of the heating zone to define a semicircle. The hot supply bus bar 20*a* is connected to a hot lead of the power system. A return supply bus bar 20*b* is disposed along the opposite half of the outer edge to define a complementary semicircle. The return supply bus bar 20*b* is connected to a return lead of the power system. A common bus bar 20*c* is provided at the center of the heating zone. The bus bars 20 preferably have a radial dimension between 3.0 and 7.0 mm. The resistive film 14 fills the space between the bus bars 20*a*, 20*b* around the outer edge and the common bus bar 20*c*. Preferably, the resistance of the resistive film varies along a radial path, for example in rings or as a circular spectrum. In one preferred arrangement, the resistive film is applied as an outer ring 14*a* and an inner ring 14*b*. The outer ring 14*a* has a radial dimension of about 27.8 mm and a thickness providing a sheet resistivity of 100Ω/square. The inner ring has a radial dimension of about 17.2 mm and a thickness providing a sheet resistivity of 40Ω/square. An insulating partition 30 of dielectric material separates the hot bus bar 20*a* from the return bus bar 20*b* and divides the resistive film 14 into two crescents. An insulating disk 31 is provided at the center. This arrangement provides about 1200 W at 240 VAC. Preferably the bus bars 20 connected to the power source extend away from the heating zone to provide connection terminals 32. The terminals are connected to the leads from the power source. The terminals are spaced about 30 to 300 mm from the heating zone to reduce the effects of heat on the connections. For example, the bus bars are run along one of the tongues (25*a*, FIG. 2) supporting the heating zone so that the terminals are located on a cooler part or edge of the cook top.

Figure 5:
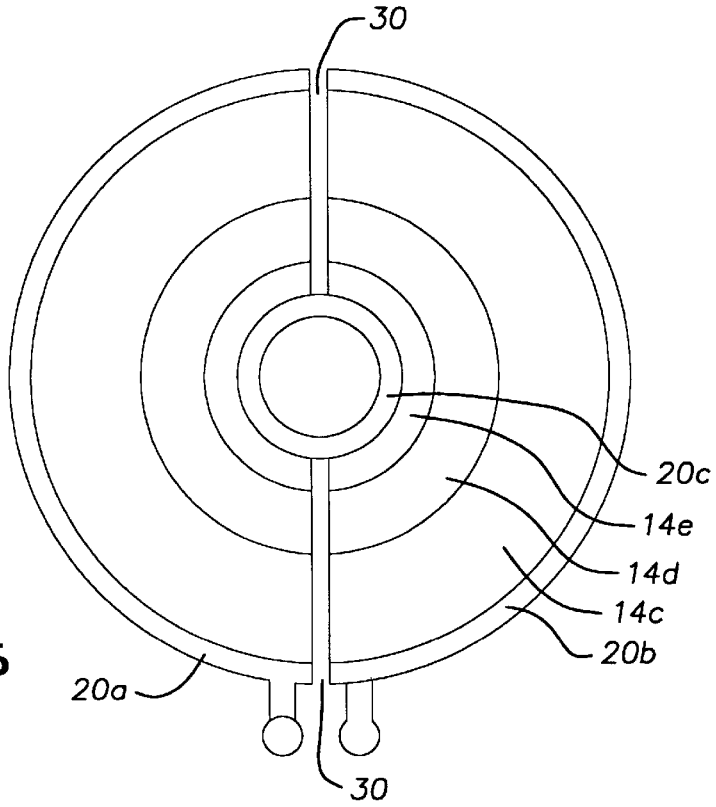
FIG. 5 shows a schematic diagram of a two-phase heater according to another aspect of the invention.

Referring to FIG. 5, the arrangement of FIG. 4 can be provided with an additional ring of resistive film having different sheet resistivities. For example, a first outer ring 14*c* has a radial dimension of about 27.8 mm and a sheet resistivity of about 110Ω/square. A second outer ring 14*d* has a radial dimension of about 9.6 mm and a sheet resistivity of about 50Ω/square. An inner ring 14*e* has a radial dimension of 7.5 mm and a sheet resistivity of about 30Ω/square.

Figure 6:
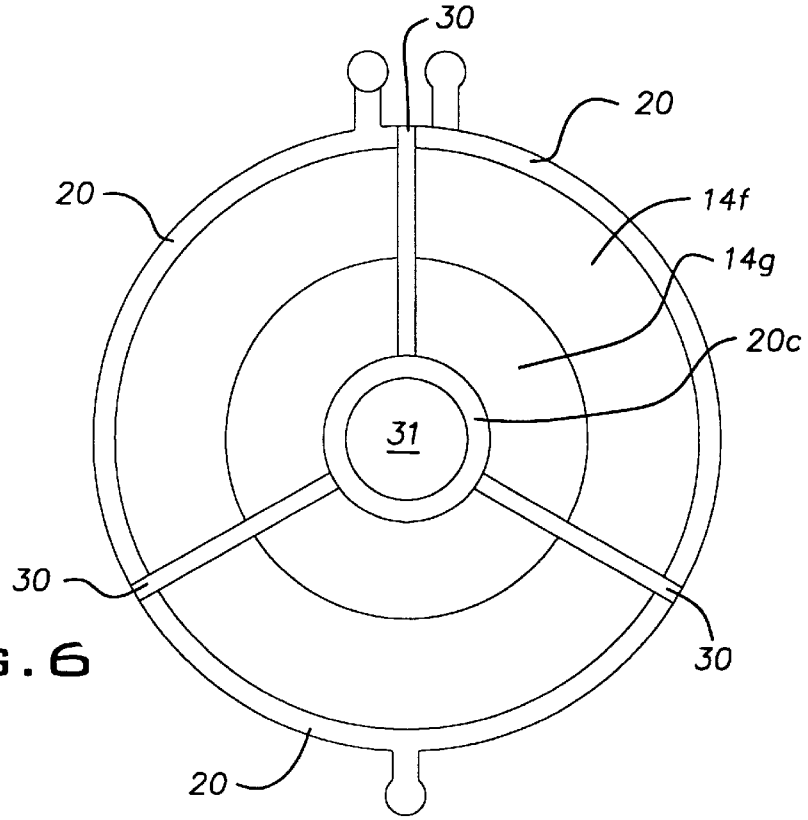
FIG. 6 shows a schematic diagram of a three-phase heater according to the invention.

FIG. 6 shows an arrangement suitable for a three-phase power supply. The heating zone is divided into three substantially identical segments by insulating partitions 30. Respective supply bus bars 20 are arranged along the outer edge of each third and connected to respective phases of the power source. The resistance of the resistive film varies along a radial path. For example, an outer ring 14*f* in each segment has a radial dimension of 27.8 mm and a sheet resistivity of 380Ω/square. An inner ring 14*g* in each segment has a radial dimension of 17.2 mm and a sheet resistivity of 170Ω/square. A common bus bar 20*c* electrically connects the films of the three segments. This arrangement provides about 1200 W at 400 V, 3-phase.

Figure 7:
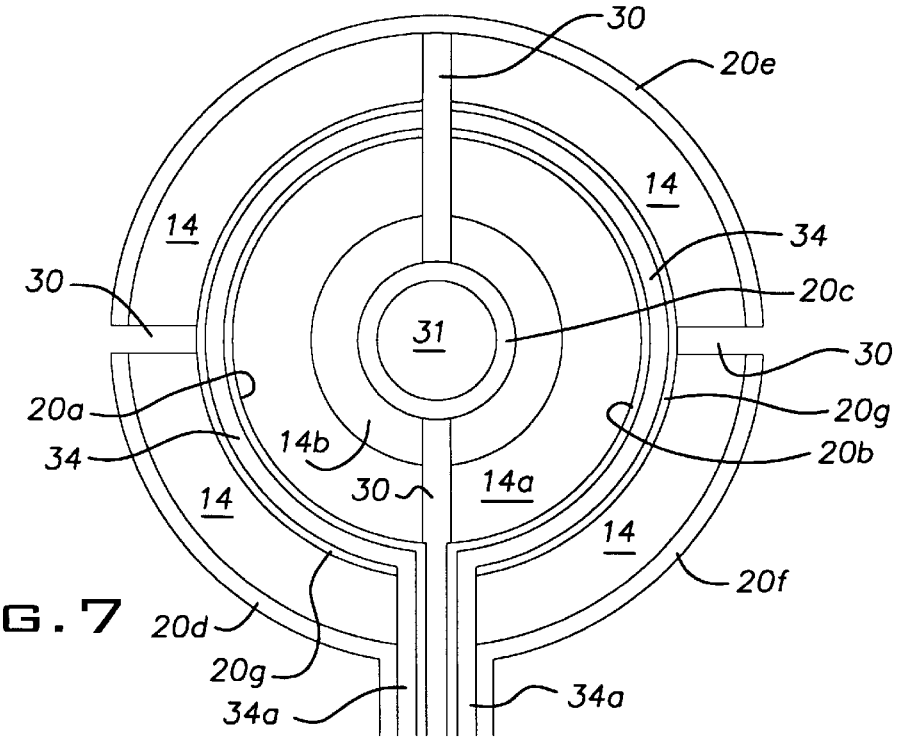
FIG. 7 shows a schematic diagram of a dual two-phase heater according to the invention.

Referring to FIG. 7, a dual heating zone has an inner heating area surrounded by an outer heating area. The inner heating area is substantially identical to the heating zone configuration shown in FIG. 4. That is, a hot supply bus bar 20*a* is disposed along half of the outer edge of the heating zone to define a semicircle. The hot bus bar 20*a* is connected to a hot lead of the power system. A return supply bus bar 20*b* is disposed along the opposite half of the outer edge to define a complementary semicircle. The return bus bar 20*b* is connected to a return lead of the power system. A circular common bus bar 20*c* is provided at the center of the heating zone. The bus bars 20 preferably have a radial dimension between 6.0 and 7.0 mm. The resistive film 14*a*, 14*b* fills the space between the bus bars 20*a*, 20*b* around the outer edge and the common bus bar 20*c*. Preferably, the resistance of the resistive film varies along a radial path, for example in rings or as a circular spectrum. In one preferred arrangement, the resistive film is applied in as an outer ring 14*a* and an inner ring 14*b*. The outer ring 14*a* has a radial dimension of about 27.8 mm and a thickness providing a sheet resistivity of 100Ω/square. The inner ring has a radial dimension of about 17.2 mm and a thickness providing a sheet resistivity of 40Ω/square. An insulating partition 30 of dielectric material separates the hot bus bar 20*a* from the return bus bar 20*b* and divides the resistive film 14 into two crescents. An insulating disk 31 is provided at the center.

The outer area is spaced from the inner area by an insulating ring 34 divided into two semi-circular parts. The ring 34 has a radial dimension of about 6.35 mm. The resistive film 14 in the outer area is divided into four segments each having a radial dimension of about 24.28 mm and a resistivity of about 100Ω/square. The segments are separated by respective insulating partitions 30 about 9.5 mm wide. A hot outer supply bus bar 20*d* connected to a hot lead is disposed along one quarter of the outer edge of the outer area. A connecting outer bus bar 20*e* is disposed along half of the outer edge and interconnects two segments of the resistive film. A return outer supply bus bar 20*f* connected to a return lead is disposed along a remaining quarter of the outer edge. The outer bus bars have radial dimensions of about 6.35 mm. Inner bus bars 20*g* of the outer area extend along respective halves of the inner edge of the outer area and interconnect two respective segments of the resistive film 14. The inner bus bars have radial dimensions of about 3.175 mm. The film and bus bars are disposed to create a continuous path from the hot lead to the return lead through each bus bar and film segment in series. Ends 34*a* of the insulating ring 34 extend radially to separate the bus bars 20*a*, 20*b* of the inner area from the bus bars 20*d*, 20*f* of the outer area. The respective hot leads of the inner and outer heating zones are connected and controlled separately so that the temperature of the inner zone can be controlled separately from the outer zone. For example, the dual heating zone can be used for small pots by activating only the inner zone and for large pots by activating both the inner and outer zones. Alternatively, the hot bus bars 20*a*, 20*d* of the inner and outer areas can be connected together and the return bus bars 20*b*, 20*f* of the inner and outer areas can be connected together so that the inner and outer areas are controlled together.

The present disclosure describes several embodiments of the invention, however, the invention is not limited to these embodiments. Other variations are contemplated to be within the spirit and scope of the invention and appended claims.

What is claimed is:

1. A heater comprising:

a substrate;

a slot through the substrate to define a heating zone;

a resistive layer applied to the substrate over at least part of the heating zone; and bus bars connected to provide a voltage across the resistive layer.

2. A heater according to claim 1, further comprising tongues interrupting the slot and supporting the heating zone.

3. A heater according to claim 2, wherein the tongues are formed by substrate material remaining when the slot is formed.

4. A heater according to claim 2, wherein the tongues are serpentine.

5. A heater according to claim 1, further comprising a thermally insulating insert disposed in the slot.

6. A heater according to claim 5, wherein top surface of the insert is substantially coplanar with a top surface of the substrate to form a smooth cook top.

7. A heater according to claim 5, further comprising a sealant between the insert and the substrate.

8. A heater according to claim 5, wherein edges of the slot support the insert.

9. A heater according to claim 5, wherein the slot is beveled.

10. A heater according to claim 9, wherein the insert is dovetailed to complement the slot.

11. A heater according to claim 5, wherein edges of the slot are stepped.

12. A heater according to claim 11, wherein the insert is stepped to complement the slot.

13. A heater according to claim 1, further comprising a sealing layer disposed over the resistive layer.

14. A heater according to claim 1, wherein the slot is through the substrate and has beveled edges, tongues formed by substrate material remaining when the slot is formed interrupt the slot and support the heating zone; and further comprising a thermally insulating insert dovetailed to complement the slot and disposed in the slot; and a sealant between the insert and the substrate.

* * * * *